US009691565B2

(12) United States Patent
Maloney et al.

(10) Patent No.: US 9,691,565 B2
(45) Date of Patent: Jun. 27, 2017

(54) SPLATTER RESISTANCE IN CIRCUIT BREAKERS

(71) Applicant: EATON CORPORATION, Cleveland, OH (US)

(72) Inventors: James G. Maloney, Industry, PA (US); James Miller Werner, Whitehall, MI (US); Alaa Abdel-Azim Elmoursi, Troy, MI (US)

(73) Assignee: Eaton Corporation, Cleveland, OH (US)

( * ) Notice: Subject to any disclaimer, the term of this patent is extended or adjusted under 35 U.S.C. 154(b) by 260 days.

(21) Appl. No.: 14/077,507

(22) Filed: Nov. 12, 2013

(65) Prior Publication Data

US 2014/0083828 A1 Mar. 27, 2014

Related U.S. Application Data

(63) Continuation of application No. 12/632,185, filed on Dec. 7, 2009, now abandoned.

(51) Int. Cl.

*H01H 9/04* (2006.01)
*H01H 71/16* (2006.01)
*H01H 11/00* (2006.01)

(52) U.S. Cl.

CPC ..... *H01H 9/04* (2013.01); *H01H 11/00* (2013.01); *H01H 71/16* (2013.01)

(58) Field of Classification Search

CPC ..... H01H 9/04; H01H 11/00; H01H 1/021; H01H 1/027; H01H 2085/0283; H01H 2300/036; H01H 31/127; H01H 33/027; H01H 33/125; H01H 71/70; H01H 75/04; H01H 85/046; H01H 85/10; H01H 85/12; H01H 9/36

USPC ..... 218/1, 22–84, 155–158, 143–145; 428/548, 550

See application file for complete search history.

(56) References Cited

U.S. PATENT DOCUMENTS 2,757,262 A * 7/1956 Yeamans ..... H01H 73/18 218/89
2,816,990 A * 12/1957 Gelzheiser ..... H01H 9/48 174/110 S
4,562,322 A * 12/1985 Yamaguchi ..... H01H 33/021 174/110 N
5,326,947 A 7/1994 Edds et al.
(Continued)

OTHER PUBLICATIONS

European Patent Office, "International Search Report and Written Opinion for PCT/US2014/061667", Jul. 10, 2015, 24 pp.

*Primary Examiner* — Truc Nguyen
(74) *Attorney, Agent, or Firm* — Eckert Seamans; Carol Marmo; Grant Coffield

(57) ABSTRACT

The disclosed concept pertains to coating compositions, methods of applying the compositions, and coated components produced therefrom. The coating compositions include alkyd or modified alkyd. The coatings are formed on surfaces of one or more internal components positioned within an electrical system, such as a circuit breaker. In the event of electrical arcing and the metal splatter produced therefrom, the coatings of the disclosed concept are effective to at least partially protect the component surface from the metal splatter and to at least partially impart splatter resistance to the component surface such that the metal splatter does not tend to adhere thereto.

14 Claims, 4 Drawing Sheets

(56) References Cited

U.S. PATENT DOCUMENTS

| | | | | |
|---|---|---|---|---|
| 5,596,184 | A * | 1/1997 | Mitsuhashi | H01H 9/302 218/32 |
| 6,183,886 | B1 * | 2/2001 | Chen | C23C 28/00 148/537 |
| 6,242,707 | B1 | 6/2001 | Mody et al. | |
| 6,373,016 | B2 * | 4/2002 | Brouillat | H01H 9/302 218/154 |
| 2003/0194576 | A1 * | 10/2003 | Cooper | C23C 4/18 428/626 |
| 2005/0058689 | A1 * | 3/2005 | McDaniel | A01N 37/46 424/426 |
| 2011/0132875 | A1 | 6/2011 | Werner et al. | |

* cited by examiner

SPLATTER RESISTANCE IN CIRCUIT BREAKERS

CROSS-REFERENCE TO RELATED APPLICATIONS

This is a Continuation-In-Part (CIP) Application which claims the benefit of priority to U.S. patent application Ser. No. 12/632,185 filed on Dec. 7, 2009, entitled "Splatter Resistance in Circuit Breakers", which is currently pending and the entirety of which is incorporated herein by reference.

BACKGROUND

Field

The disclosed concept pertains generally to coating compositions, methods of applying the compositions to form coatings, and coated substrates. In particular, the disclosed concept pertains to coating and/or coated components in electrical systems, such as circuit breakers, to impart splatter resistance to the surfaces of the components.

Background Information

Electrical arcing is known to occur when a circuit breaker opens causing metal in the contacts to superheat and become molten metal. The molten metal is propelled by ionized air and gasses throughout the interior of the circuit breaker as the contacts open. Deposits of molten metal, or "splatter", cool and solidify on surfaces where they are propelled and may interfere with the functionality of the circuit breaker. For example, the metal deposits may interfere with the motion of mechanical components and prevent proper operation. The metal deposits may also electrically connect circuit breaker components causing a short circuit.

Often, circuit breakers have design features which contribute to mitigating the effects of metal splatter by preventing contact between the metal splatter and circuit breaker components. Some circuit breakers include physical barriers or shields that protect certain components from being contacted by the metal splatter. Other circuit breakers include venting features that attempt to direct the ionized air, gasses and the metal splatter out of the circuit breaker so that the gasses will not propel the metal splatter in contact with the surface of internal circuit breaker components.

It is an object of the disclosed concept to develop compositions for use in coating the surfaces of one or more internal components of a circuit breaker such that the coating protects the (uncoated) surface from contact with metal splatter. Further, it is an object of the disclosed concept to coat surfaces of one or more internal components of a circuit breaker with coating compositions that are effective to impart metal splatter resistance to the surfaces of the components. Furthermore, it is an object of the disclosed concept to provide coating compositions that are effective to at least partially preclude or minimize the adherence of the metal splatter to the surfaces of the internal circuit breaker components when the surfaces are coated with the compositions.

SUMMARY

These needs and others are met by embodiments of the disclosed concept, which provides coating compositions, methods for coating components in a circuit breaker and the coated components produced therefrom.

In an aspect, the disclosed concept provides a method of at least partially coating a component of an electrical system. The electrical system includes a housing and the component is positioned within the housing. The method includes obtaining the component having an exterior surface and applying to at least a portion of the exterior surface of the component a coating composition to form a coating thereon. The coating is effective to impart at least partial resistance to molten metal splatter adhering to the exterior surface of the component.

The component for coating may be a component of a trip mechanism in the electrical system. In certain embodiments, the component is a bimetal device.

The coating composition may be applied using a technique selected from spraying, rolling, brushing, and dipping.

The metal splatter may be produced from electrical arcing within the housing of the electrical system.

The coating composition includes alkyd. Further, the coating composition may include a mixture of aromatic hydrocarbons. Furthermore, the coating composition may include xylene, ethyl benzene and naptha. In certain embodiments, the coating composition includes from about 11 to about 12 weight percent xylene, from about 2 to about 8 weight percent ethyl benzene and from about 8 to about 10 weight percent naptha, based on total weight of the composition. In other embodiments, the coating composition includes from about 20 to about 22 weight percent xylene, from about 2 to about 8 weight percent ethyl benzene and from about 8 to about 10 weight percent naptha, based on total weight of the composition. In still other embodiments, the coating composition includes at least one of boron nitride, molybdenum disulfide, fluoropolymer and graphite.

Prior to applying the coating composition, the uncoated exterior surface of the component may be pre-treated.

The coating composition may have solids content of from about 63% to about 70% by weight based on total weight of the composition.

The electrical system may be a circuit breaker.

In another aspect, the disclosed concept provides an at least partially coated component in an electrical system. The at least partially coated component includes at least one component of a trip mechanism in the electrical system having an outer surface and a coating composition applied to at least a portion of the outer surface of the at least one component of the trip mechanism to form a coating on the outer surface. The coating is effective to impart at least partial resistance to molten metal splatter adhering on the surface of the at least one component of the trip mechanism.

The coating composition may be in the form of a tape comprising aromatic hydrocarbon.

The outer surface may be electroplated with tin and the tin may be coated with the coating composition.

The electrical system may be a circuit breaker.

In another aspect, the disclosed concept provides a component of a circuit breaker having deposited thereon a coating composition effective to render an exterior surface of the component at least partially resistant to adherence of metal splatter, the metal splatter produced from electrical arcing in the circuit breaker, the coating composition comprising a material selected from the group consisting of a blend of xylene, ethyl benzene, and naptha, boron nitride, molybdenum disulfide, fluoropolymer, and graphite.

BRIEF DESCRIPTION OF DRAWINGS

The accompanying drawings, which are incorporated in and constitute a part of the specification, illustrate various example systems, methods, and other example embodiments of various aspects of the disclosed concept. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

A full understanding of the disclosed concept can be gained from the following description of the preferred embodiments when read in conjunction with the accompanying drawings in which.

DETAILED DESCRIPTION OF PREFERRED EMBODIMENTS

Figure 1:
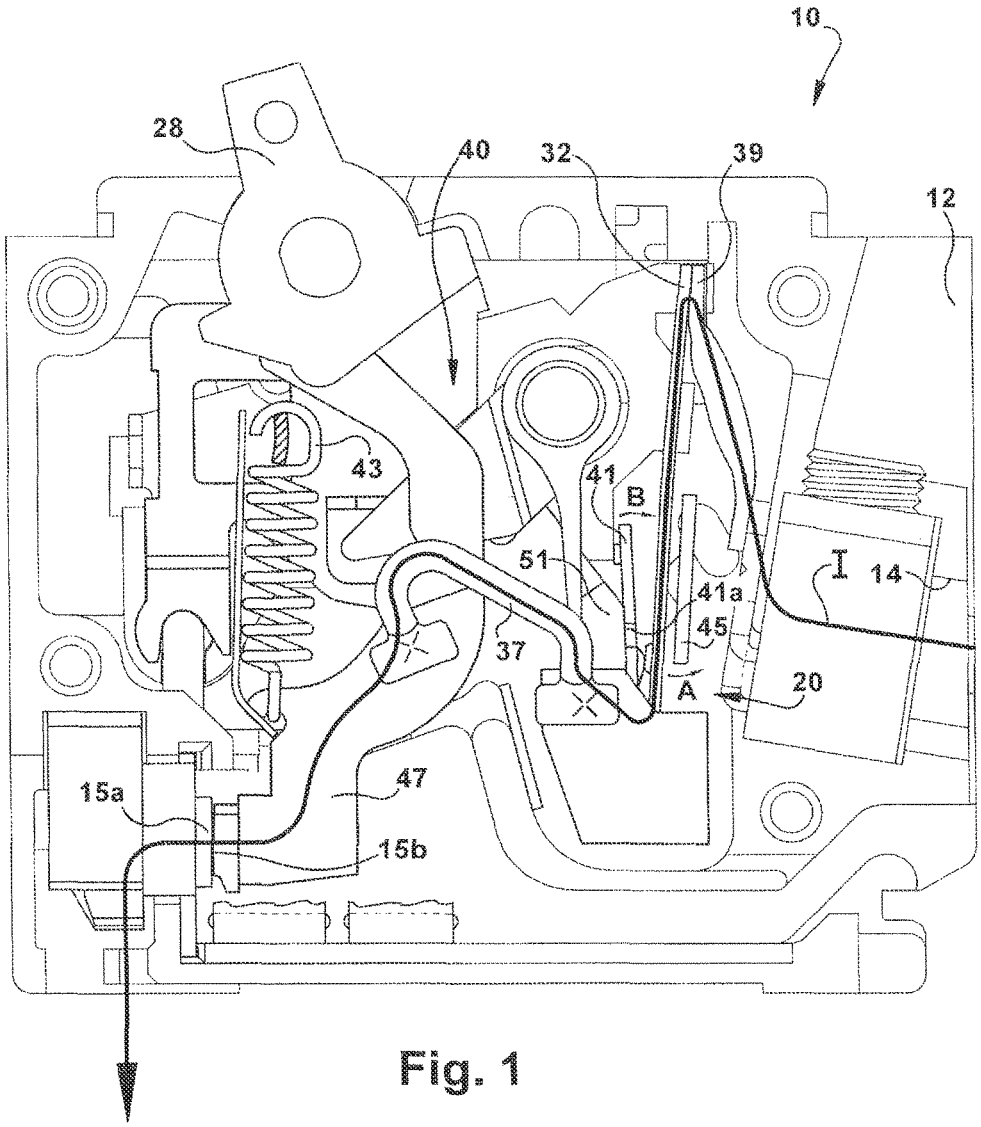
FIG. 1 is a schematic view of a circuit breaker in an electrically closed or current conducting condition, in accordance with the prior art.

The disclosed concept includes coating compositions, methods of preparing the coating compositions and applying the coating compositions to components in electrical systems, such as circuit breakers, and the coated components produced therefrom. The coating compositions include materials that when deposited on a surface of a substrate form a coating thereon. The coating is effective to at least partially cover and protect the underlying surface of the substrate from contact with molten metal, e.g., splatter, and further, the coating can be effective to impart resistance to the adherence of molten metal, e.g., splatter, on the coated surface of the substrate.

Directional phrases used herein and the claims, such as, for example, "left," "right," "top," "bottom," "upper," "lower," "front," "back," "forward," "above," "below," "clockwise," "counter clockwise" and derivatives thereof, relate to the orientation of the elements shown in the drawings and are not limiting to the claims unless expressly recited therein.

As employed herein and the claims, the statement that two or more parts are "coupled" or "connected" together shall mean that the parts are joined together either directly or joined through one or more intermediate parts.

As employed herein and the claims, the term "number" means one or an integer greater than one (i.e., a plurality). References to "one embodiment", "an embodiment", "one example", "an example", and so on, indicate that the embodiment(s) or example(s) so described may include a particular feature, structure, characteristic, property, element, or limitation, but that not every embodiment or example necessarily includes that particular feature, structure, characteristic, property, element or limitation.

For the purposes of this disclosure, when content is indicated as being present on a "weight basis" the content is measured as the percentage of the weight of component(s) indicated, relative to the total weight of the composition.

For ease of description, the disclosed concept is described herein in association with circuit breakers and components positioned within the circuit breakers. However, the disclosed concept is applicable for coating components in a wide range of electrical systems to impart resistance to the adherence of molten metal on the surfaces of the components.

The disclosed concept relates to compositions that when deposited on a surface of a component forms a coating on at least a portion of the surface which is effective to render the coated surface splatter-resistant such that metal splatter does not substantially adhere to the surface of the component. As used herein and the claims, the term "splatter" refers to molten metal that is generated in a circuit breaker as a result of electrical arcing. Further, as used herein and the claims, the term "component" refers to any internal parts of a circuit breaker. For example, as used herein, the term "component" can refer to one or more parts of a trip mechanism of a circuit breaker. It is known in the art that electrical arcing occurs when a circuit breaker opens and as a result, causes metal in the contacts to superheat and become molten metal. The molten metal is propelled by ionized air and gasses throughout the interior of the circuit breaker as the contacts open and deposit on internal surfaces of the circuit breaker. The deposit of molten metal or splatter then cools and solidifies on the surfaces and may interfere with the functionality of the circuit breaker.

The internal components of a circuit breaker are typically not constructed of material that is splatter-resistant. Thus, it is an object of the disclosed concept to apply a composition to the surface of the component to forma coating to protect the (non-splatter-resistant surface of the component) from being contacted by the splatter.

In general, the method of applying the composition includes obtaining a component having an uncoated exterior or outer surface and at least partially applying to the uncoated exterior or outer surface a composition to form a coating thereon. The coating is effective to protect the uncoated surface of the component from contact with metal splatter. Further, the coating can be effective to at least partially repel splatter, e.g., reduce the ability of the splatter to adhere thereto.

In the disclosed concept, the splatter-resistant surface significantly reduces the amount of metal splatter that adheres to the surface of the component and in turn increases the reliability of the circuit breaker. In the prior art, as previously described herein, attempts have been made to prevent metal splatter from contacting circuit breaker trip mechanism components. In the disclosed concept, instead of preventing the metal splatter from contacting a component, a coating is applied to the surface of the component to substantially prevent the splatter from adhering when it contacts a component surface.

Considerations in selecting a composition for use in the disclosed concept include the compatibility between the surface to be coated and the composition as well as the ability of the coating to repel splatter. For example, suitable compositions are compatible with, and show good adhesion to, a wide variety of surfaces including but not limited to, those of materials that are typically used for constructing internal components of a circuit breaker, e.g., metals, ceramics, and plastics, while being effective to reduce, minimize or preclude the adherence of splatter to the coating.

FIG. 1 shows a circuit breaker 10 in accordance with certain embodiments of the disclosed concept. The circuit breaker 10 includes a housing 12 which is may be constructed of various materials known in the art, such as metal, metal alloy, ceramic, plastic and composites thereof. In certain embodiments, the housing 12 is composed of electrically insulating material such as a thermosetting resin. The dimensions of the circuit breaker 10 can vary and typically has dimensions of approximately 3 inches in length, 2 inches in height, and 1 inch in width. With these dimensions the circuit breaker 10 is adapted to fit into a conventional load center box and panel cover.

The circuit breaker 10 includes a pair of co-operable contacts 15*a*, 15*b* which are shown in FIG. 1 in a closed position.

Figure 2:
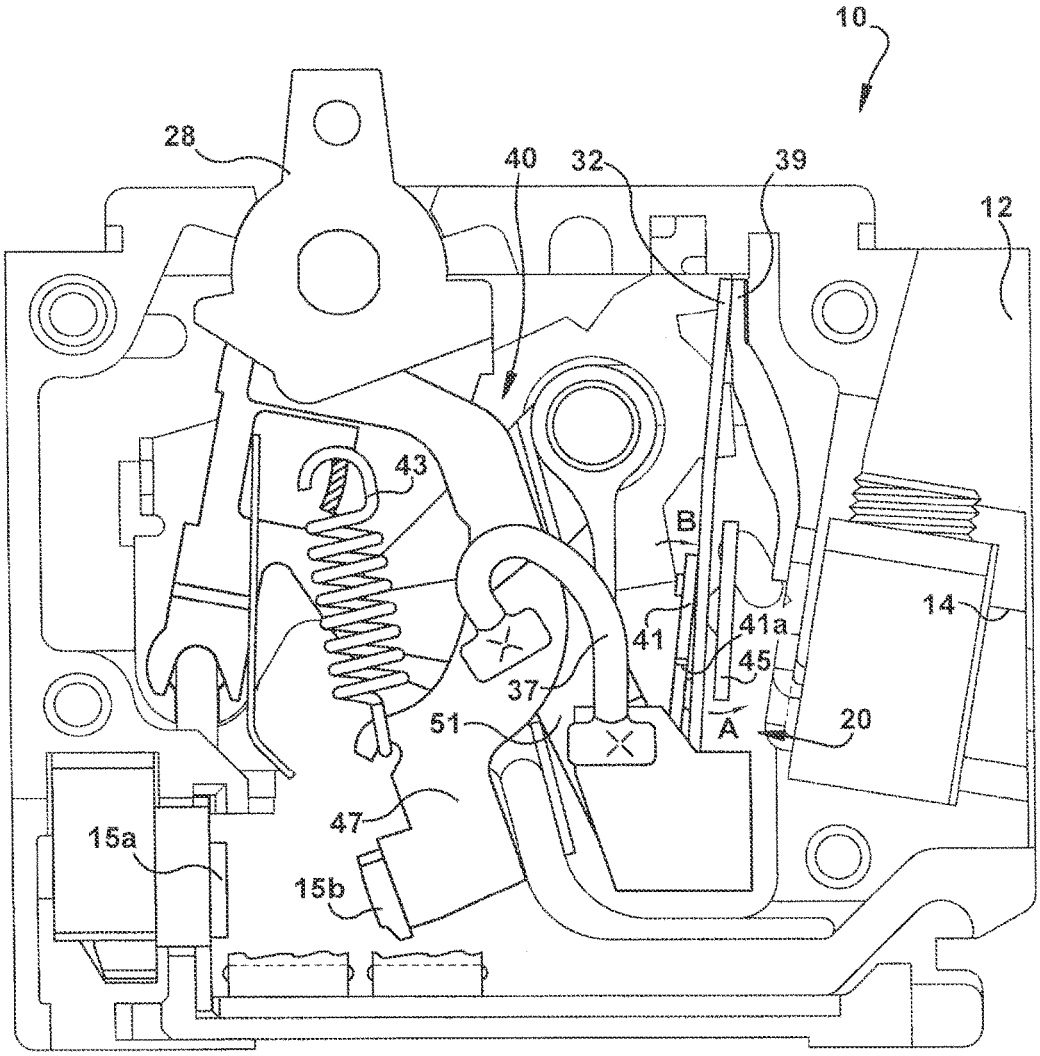
FIG. 2 is a schematic view of the circuit breaker of FIG. 1 in an electrically open condition, in accordance with the prior art.

FIG. 2 shows the circuit breaker 10 as shown in FIG. 1 including the housing 12 and the pair of co-operable contacts 15*a*, 15*b*, with the exception that the pair of co-operable contacts 15*a*, 15*b* is shown in the open position. The pair of co-operable contacts 15*a*, 15*b* is moveable between a closed position shown in FIG. 1 and an open position shown in FIG. 2.

As shown in FIGS. 1 and 2, a mechanical linkage, indicated generally as 40, moves the pair of co-operable contacts 15*a*, 15*b* in response to actuation of a reset lever 28 or operation of a trip mechanism 20. The details of the mechanical linkage 40 and reset lever 28 are not included herein for the sake of brevity. A similar mechanical linkage is described in U.S. Pat. No. 4,081,852. The description of which is incorporated herein by reference.

The trip mechanism 20 includes one or more trip mechanism components having characteristics that are altered by the amount and/or character of current flowing through the circuit breaker. In certain embodiments, the trip mechanism component is a current carrying member that carries current flowing through the circuit breaker. In accordance with the disclosed concept, the one or more components of the trip mechanism 20 may be coated with the composition of the disclosed concept to protect the uncoated surface from contact with metal splatter and to impart a splatter-resistant surface thereto.

As shown in FIG. 1, the trip mechanism 20 includes a bimetal device 32 that is a flat member secured at an upper end to a stationary housing projection 39. A lower end of the bimetal device 32 is not anchored and is free to deflect in a direction indicated by the arrow labeled "A" in FIG. 1. When the bimetal device 32 is cold, it takes the straightened position shown in FIG. 1. When the bimetal is heated, it deflects in the direction shown by the arrow "A". The bimetal device 32 is selected to have deflection properties that provide proper circuit breaker operation at expected operating currents and to actuate the mechanical linkage 40 when current levels exceed an acceptable level, as will be explained in more detail below. While the trip mechanism 20 illustrated in FIG. 1 includes a bimetal device 32, it will be understood by one of skill in the art that the trip mechanism 20 may employ other devices, such as, for example, magnets, solenoids, and the like. The bimetal device 32 as well as other devices employed by the trip mechanism 20 may be coated with the composition of the disclosed concept to protect the uncoated surface from contact with metal splatter and to impart a splatter-resistant surface thereto.

In FIG. 1, current flow is indicated by the heavy arrow "I". Current enters the circuit breaker through an entrance 14 on a conductor (not shown). The current flows through the bimetal device 32, a flexible conductor 37, and a moving arm 47 that carries one of the pair of co-operable contacts 15*b*. In its straightened position, the bimetal device 32 supports a moveable armature 41 in the position shown in FIG. 1. The armature 41 includes a latch surface 41*a* that engages a latch member 51. The latch member holds the mechanical linkage 40 against the biasing force of a spring 43 that urges the mechanical linkage 40 to the open contact position (as shown in FIG. 2). During normal operation, deflection of the bimetal device 32 due to current flow is not sufficient to allow the latch member 51 to disengage the latch surface 41*a* of the armature and rotate in a clockwise direction to the open position.

When an overcurrent condition exists, the bimetal device 32 further deflects and moves the armature 41 and its latch surface 41*a* out of engagement with the latch member 51. The mechanical linkage 40 is then urged by the spring into the open position (as shown in FIG. 2).

In certain embodiments, the circuit breaker 10 includes a feature that opens the pair of co-operable contacts 15*a*, 15*b* in response to a sudden spike in current. A magnetic member 45 is placed in proximity to the bimetal device 32. The current in the bimetal device 32 induces a magnetic force in the magnetic member 45. When the current reaches a predetermined level, the magnetic force becomes sufficient to move the armature 41 in the direction indicated by the arrow "B". This motion pulls the latch surface 41*a* out of engagement with the latch member 51 to allow the pair of co-operable contacts 15*a*, 15*b* to open (as shown in FIG. 2).

Figure 3:
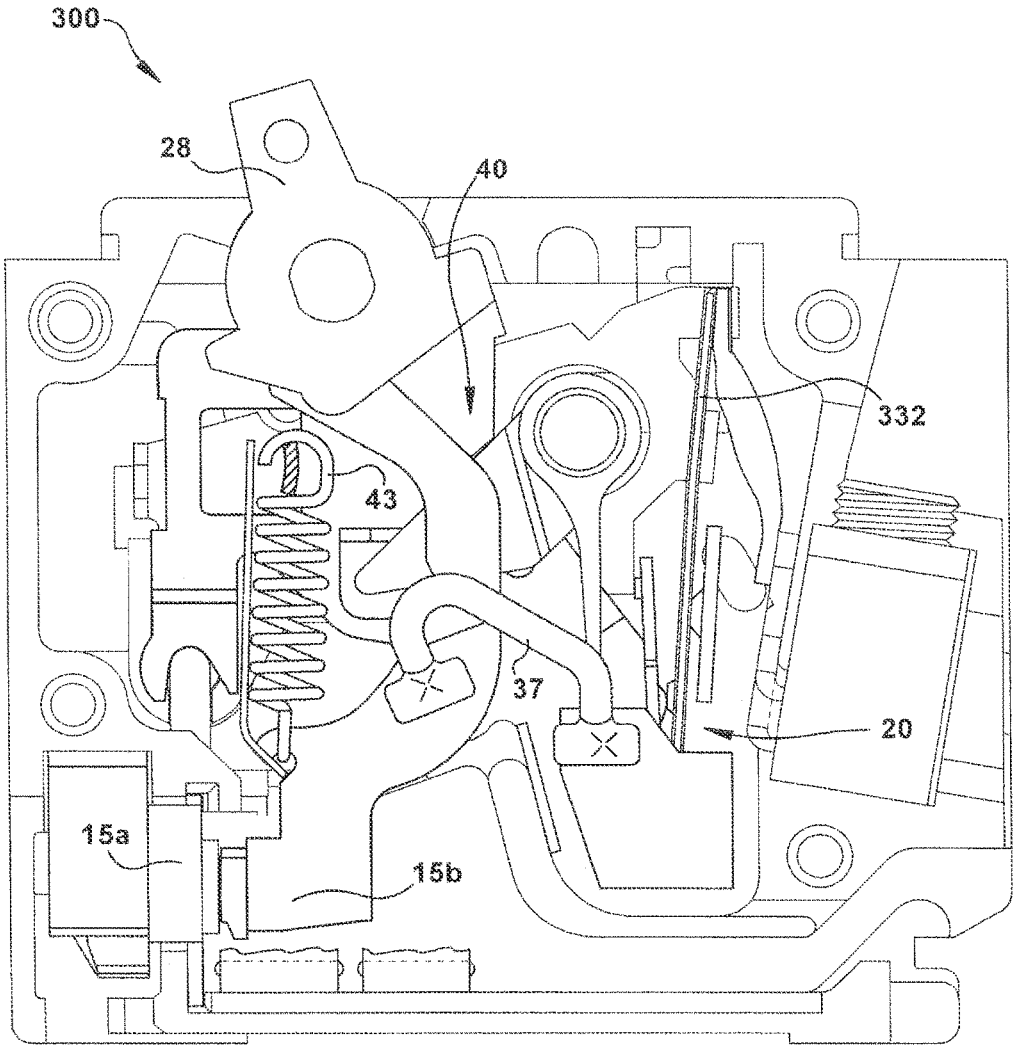
FIG. 3 is a schematic view of a circuit breaker that includes a component with a splatter resistant surface coating, in accordance with certain embodiments of the disclosed concept.
Figure 4:
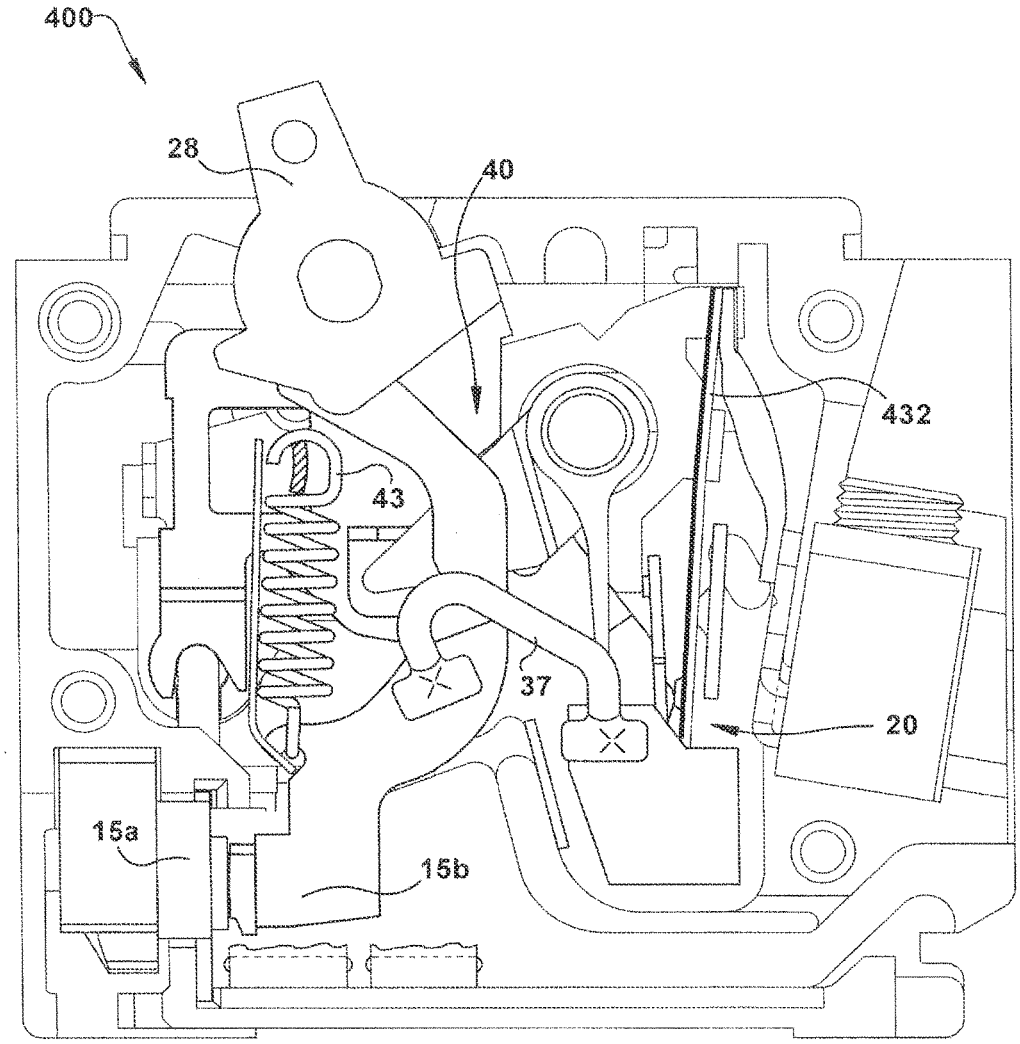
FIG. 4 is a schematic view of another circuit breaker that includes a component with a splatter resistant surface coating, in accordance with certain embodiments of the disclosed concept.

FIGS. 3 and 4 show circuit breakers 300, 400 that have a trip mechanism component that includes at least one splatter resistant surface in accordance with certain embodiments of the disclosed concept. As described herein, the splatter resistant surface at least partially covers the uncoated component surface to protect it from contact with metal splatter and the coating can be effective to repel metal splatter such that the splatter does not tend to adhere to the coated surface. FIG. 3 is a schematic diagram of an embodiment of a circuit breaker 300 that includes a bimetal device 332. The bimetal device 332 has a splatter resistant coating applied thereon. FIG. 4 shows another embodiment of a circuit breaker 400 with a trip mechanism component that includes a splatter resistant surface. The circuit breaker 400 includes a bimetal device 432 having solid lubricant carrying tape adhered to one side.

The composition of the disclosed concept may be applied to one or more of the components of the trip mechanism 20 to render the surface(s) substantially splatter-resistant. Further, other circuit breaker components may include a splatter-resistant coated surface instead of or in addition to the one or more trip mechanism components. For example, the spring 43 (as shown in FIG. 1) or other mechanical linkage 40 components may be coated with the splatter-resistant composition of the disclosed concept.

The composition of the disclosed concept may form a solid lubricant coating, e.g., a solid lubricant suspended in a liquid solution and deposited by an aerosol spray, or an enamel coating which at least partially covers the uncoated surface to protect it from contact with metal splatter and to impart splatter resistant properties to the component surface. In certain embodiments, the composition includes alkyd, e.g., a modified alkyd. In general, alkyds are known for use as resins or binders in protective coating compositions, such as but not limited to paint. The composition may also include other components, such as but not limited to, one or more hydrocarbons which are also known for use in protective coating compositions.

In certain embodiments, the composition is alkyd or modified alkyd including a mixture or blend of hydrocarbons, e.g., aromatic hydrocarbons. The composition can also include one or more of carriers, binders and solvents. Suitable hydrocarbons include, but are not limited to, xylene, ethyl benzene, heavy aromatic solvent naptha.

Naptha is a known liquid mixture of hydrocarbons which contains napthalene. The composition typically has high solids content, for example, from about 63% to about 70% by weight based on total weight of the composition. The amount of the components within the composition can vary. In certain embodiments, the composition constitutes the following components and amounts: xylene from about 11% to about 12%, ethyl benzene from about 2% to about 8%, heavy aromatic solvent naptha from about 8% to about 10% based on total weight of the composition, the remainder being water. In certain other embodiments, the composition constitutes the following components and amounts: xylene from about 20% to about 22%, ethyl benzene from about 2% to about 8%, heavy aromatic solvent naptha from about 8% to about 10% based on total weight of the composition, the remainder being water.

As above-mentioned, the coating composition can be in the form of a solid lubricant carrying tape, such as but not limited to, Teflon® tape which is commercially available from DuPont Company. Teflon is a well known fluoropolymer resin, e.g., polytetrafluoroethylene (PTFE).

In certain embodiments, the composition is in the form of a solid lubricant and includes at least one of boron nitride, molybdenum disulfide, fluoropolymer, and graphite.

The compositions of the disclosed concept can be deposited on or applied to a surface of a circuit breaker component, e.g., one or more trip mechanism components, using various conventional techniques including, but not limited to spraying, rolling, brushing, dipping, and the like. In certain embodiments, the coating composition can be applied by thermal deposition processes.

In certain embodiments, the surface of the component may be subjected to a preparation process prior to applying or depositing the coating composition of the disclosed concept. The preparation process can include a pre-coating or pre-treatment to the substrate to facilitate or enhance applying and/or adhesion of the composition thereto. For example, the preparation process can include applying a catalyst or catalyst-containing composition to the surface of the component prior to applying the composition, such that the composition is applied onto the catalyst instead of being directly applied to the surface of the component.

Following application, the composition is then allowed to set and/or cure to form a coating on the surface of the component. The cure can be carried out under a variety of conventional temperature and pressure conditions which are known in the art for curing. In one embodiment, the cure is conducted at ambient temperature, for example but not limited to, a temperature from about 64° F. to about 73° F., and/or under atmospheric air conditions. In another embodiment, the cure is conducted at an elevated temperature. The cure temperature will depend on the selected components/ingredients of the composition. In certain embodiments, wherein the composition includes a mixture of xylene, ethyl benzene, heavy aromatic solvent and naptha, the cure temperature can be either at ambient temperature for a period of approximately 5 hours or forced cure may be employed at an elevated temperature from about 1150° F. to about 180° F.

The coatings formed from the compositions can have a broad range of thicknesses. In some embodiments the coatings will have a thickness in a range of from about 10 microns to about 225 microns; about 15 microns to about 200 microns; about 20 microns to about 150 microns; about 30 microns to about 175 microns; or about 50 microns to about 200 microns.

In accordance with the disclosed concept, the composition is applied to a surface of one or more internal components of a circuit breaker. The surface can be constructed of various materials. In certain embodiments, the component is constructed of bimetal. Further, it is known in the art to electroplate the bimetal surface with tin. Due to the low melting point of tin, i.e., approximately 450° F., suitable compositions for use in coating the bimetal surface may have a lower cure temperature than the melting point of tin.

EXAMPLES

Example 1

Solid lubricant compositions were prepared and applied to bimetal strips, including plated (with tin) and unplated samples, to form a coating thereon. The solid lubricant coatings were suspended in a liquid solution and deposited by an aerosol spray onto the bimetal strips. The compositions included boron nitride supplied by ZYP Coatings, super enhanced graphite supplied by ZYP Coatings, low-temperature cure fluoropolymer manufactured by Sun Coating, and low-temperature cure fluoropolymer manufactured by Secoa. The fluoropolymer compositions that were tested included blends of resins and fluoropolymer lubricants.

A twin-wire arc gun was used to generate metal splatter. Appropriate spray parameters were established to generate splatter from copper, 316 stainless steel, and tungsten wires. The twin-wire arc thermal spray device was sprayed on coated bimetal strips (plated with tin and unplated) and uncoated bimetal strips (controls) which were mounted on a steel plate and placed 10 feet away from the gun nozzle.

Metal splatter including copper and stainless steel was collected for 12 seconds on the bimetal samples. Metal splatter of tungsten was collected for 3 seconds on the bimetal samples. The bimetal strips were then optically analyzed and a splatter count and splatter coverage was determined for each metal component of the splatter. To determine the splatter count, each sample was scanned at 30 times with oblique lighting to count metal splatter particles. In order to determine splatter coverage, a 50 times microphotograph of the greatest splatter particle area was taken. The image was analyzed to measure the total area of splatter coverage from each photo. Splatter coverage was determined to provide a better indicator of splatter resistance.

The coatings formed by the super enhanced graphite and fluoropolymer compositions all provided significant improvement in splatter resistance as compared to the uncoated control samples. The selection of a particular composition from these suitable compositions may be dependent on cost and manufacturing considerations.

Example 2

The acceptability of Teflon® tape as a coating coating to provide a splatter-resistant surface was evaluated. The process of Example 1 was conducted with the exception that the bimetal strips had 2 or 3 mil Teflon® tape applied to the surface instead of applying the coating compositions as identified in Example 1. It was determined that the Teflon® tape was effective to render the surface of the bimetal strips splatter-resistant. Further, it was shown that the 2 mil Teflon® tape performed better than the 3 mil tape as well as the solid lubricant aerosol coatings tested in Example 1.

The Teflon® tape is cost effective but may present manufacturing challenges in applying the tape to the bimetal device.

While example systems, methods, and the like have been illustrated by describing examples, and while the examples have been described in considerable detail, it is not the intention of the applicants to restrict or in any way limit the scope of the appended claims to such detail. It is, of course, not possible to describe every conceivable combination of components or methodologies for purposes of describing the systems, methods, and so on described herein. Therefore, the disclosed concept is not limited to the specific details, the representative apparatus, and illustrative examples shown and described. Thus, this application is intended to embrace alterations, modifications, and variations that fall within the scope of the appended claims.

What is claimed is:

1. A method of at least partially coating a component of a circuit breaker, the circuit breaker including a housing and the component positioned within the housing, the method comprising:

obtaining the component having an exterior surface;

preparing a coating composition, which comprises:

a solid lubricant, which comprises a material selected from the group consisting of boron nitride, molybdenum disulfide, fluoropolymer, graphite and mixtures thereof;

applying and adhering the coating composition to at least a portion of the exterior surface of the component;

forming a protective coating on at least a portion of the exterior surface of the component to impart at least partial resistance to adherence, to the exterior surface of the component, of molten metal splatter produced from electrical arcing within the housing of the circuit breaker; and positioning the component having the protective coating applied thereon into the housing of the circuit breaker.

2. The method of claim 1, wherein the component comprises a component of a trip mechanism in the circuit breaker.

3. The method of claim 2, wherein the component comprises a bimetal device.

4. The method of claim 1, wherein applying the coating composition is selected from the group consisting of spraying, rolling, brushing, and dipping.

5. The method of claim 1, wherein the preparing the coating composition comprises:

providing a liquid solution; and suspending the solid lubricant in the liquid solution.

6. The method of claim 5, wherein the applying the coating composition comprises:

depositing the coating composition by an aerosol spray; and curing the coating composition.

7. The method of claim 1, wherein the coating composition comprises from about 11 to about 12 weight percent xylene, from about 2 to about 8 weight percent ethyl benzene and from about 8 to about 10 weight percent naptha, based on total weight of the composition.

8. The method of claim 1, wherein the coating composition comprises from about 20 to about 22 weight percent xylene, from about 2 to about 8 weight percent ethyl benzene and from about 8 to about 10 weight percent naptha, based on total weight of the composition.

9. The method of claim 1, wherein prior to applying the coating composition, the uncoated exterior surface of the component is pre-treated.

10. The method of claim 1, wherein the coating composition has solids content of from about 63% to about 70% by weight based on total weight of the composition.

11. An at least partially coated component positioned within a housing of a circuit breaker, comprising:

a circuit breaker, comprising:

a housing; and at least one component of a trip mechanism positioned in the housing of the circuit breaker having an outer surface; and a coating applied and adhered to at least a portion of the outer surface of the at least one component of the trip mechanism, the coating comprising:

a solid lubricant, which comprises a material selected from the group consisting of boron nitride, molybdenum disulfide, fluoropolymer, graphite and mixtures thereof:

wherein, the coating is effective to impart at least partial resistance to adherence, to the outer surface of the at least one component of a trip mechanism, of molten metal splatter produced from electrical arcing within the housing of the circuit breaker.

12. The coated component of claim 11, further comprising an electroplated layer of tin positioned between the outer surface and the coating.

13. The coated component of claim 11, wherein the electrical system is a circuit breaker.

14. A coated component of a circuit breaker, comprising:

the circuit breaker, comprising:

a housing; and a component positioned within the housing and having an exterior surface;

a solid lubricant applied and adhered to the exterior surface of the component, which comprises fluoropolymer and is in a form of tape, wherein, the solid lubricant is effective to render the exterior surface of the component at least partially resistant to adherence of metal splatter, the metal splatter produced from electrical arcing in the circuit breaker.

* * * * *